United States Patent [19]

Castela et al.

[11] 3,940,111

[45] Feb. 24, 1976

[54] APPARATUS FOR APPLYING A DETERMINED FORCE TO AN ELEMENT CONNECTED TO AN INSTALLATION SUBJECTED TO ALTERNATING MOVEMENTS

[75] Inventors: André Castela, Le-Mesnil-le-Roi; Philippe Joubert, Meudon-la-Foret, both of France

[73] Assignee: Institut Francaise du Petrole, des Carburants et Lubrifiants, France

[22] Filed: May 2, 1973

[21] Appl. No.: 356,388

[30] Foreign Application Priority Data

May 5, 1972 France ..... 72.16072

[52] U.S. Cl. ..... 254/172; 175/5

[51] Int. Cl.[2] ..... B66D 1/48

[58] Field of Search ..... 254/172; 175/5, 37, 27; 166/.5; 267/126, 178; 60/415 R; 60/413; 91/4 R, 390

[56] References Cited

UNITED STATES PATENTS

| | | | |
|---|---|---|---|
| 3,151,686 | 10/1964 | Kammerer | 175/5 |
| 3,208,728 | 9/1965 | Parks | 175/5 |
| 3,643,934 | 2/1972 | Bordes | 254/172 |
| 3,718,316 | 2/1973 | Larralde | 254/173 |
| 3,721,293 | 3/1973 | Ahlstone | 254/172 |

FOREIGN PATENTS OR APPLICATIONS

| | | | |
|---|---|---|---|
| 1,053,311 | 12/1966 | United Kingdom | 175/5 |

*Primary Examiner*—Robert G. Sheridan
*Assistant Examiner*—Kenneth Noland
*Attorney, Agent, or Firm*—Craig & Antonelli

[57] ABSTRACT

This apparatus comprises a main jack for supporting elements from the installation and a regulating device which includes at least one pivoting jack and makes use of a source of pressurized fluid in communication with a chamber of variable volume in which the pressure of the fluid varies in inverse proportion with respect to the volume of the chamber. The main jack and the regulating device are connected in parallel to the source of pressurized fluid and the regulating device supplies a pressurized auxiliary fluid to means for adjusting the force exerted by the main jack.

21 Claims, 9 Drawing Figures

F
6
3A
4A
5A
22A
31
8
19
16
P
Pu
15

17A
6
18A
15
Pu
8
19
7
P
16
F
1

APPARATUS FOR APPLYING A DETERMINED FORCE TO AN ELEMENT CONNECTED TO AN INSTALLATION SUBJECTED TO ALTERNATING MOVEMENTS

The present invention relates to an apparatus for applying a determined force to an element connected to an installation subjected to alternating movements.

There will be contemplated in the following, by way of non limitative example, the application of the invention to off-shore drilling operations performed from a floating installation, the apparatus of the invention being then used to apply to the drill string, at the upper part thereof, a determined force independently of the vertical movements of the floating installation.

It has already been proposed an apparatus for applying a determined force to an elongated member connected to an installation subjected to alternating movements, this prior apparatus comprising at least one main hydraulic jack and a regulating device making use of a source of pressurized fluid communicating with a chamber of variable volume, such as a hydraulic jack, the pressure of this fluid varying in inverse proportion relative to the volume of the chamber.

This prior device comprises a group of jacks having cylinder elements and piston-rod elements, one element of at least one jack of said group being connected through a moveable articulation to an element of at least another jack of said group, at least one jack of the group being pivotally mounted about a stationary point of the installation through its element which is not connected to said moveable articulation, said moveable articulation being compelled to move along a predetermined path, fixed with respect to the installation, the axis of said pivoting jack having, during its rotation, a variable angle of inclination relative to said path, at least one jack of said group being fed with pressurized fluid from said source and constituting said chamber of variable volume and at least one jack of the group supplying a pressurized working fluid.

In a device of this type which has been already proposed, the source of pressurized fluid is constituted by one or a plurality of oleopneumatic (gas-and-oil) accumulators and the regulating device is connected in series between this source of pressurized fluid and the cylinder of the main jack and supplies this main jack with pressurized working fluid.

The object of the present invention is to provide an apparatus for applying a predetermined force, formed by elements of limited size and consequently less bulky and less expensive than the prior devices, for the same accuracy of regulation.

This result is obtained by a special "parallel" connection of the elements forming the apparatus, this arrangement being substituted for the conventional "series" connection used in the apparatuses which have been proposed up to now.

The invention will be better understood from the following description of non limitative embodiments diagrammatically illustrated by the accompanying drawings, wherein.

In the drawings the same reference numerals have been used to designate the same elements.

Figure 1:
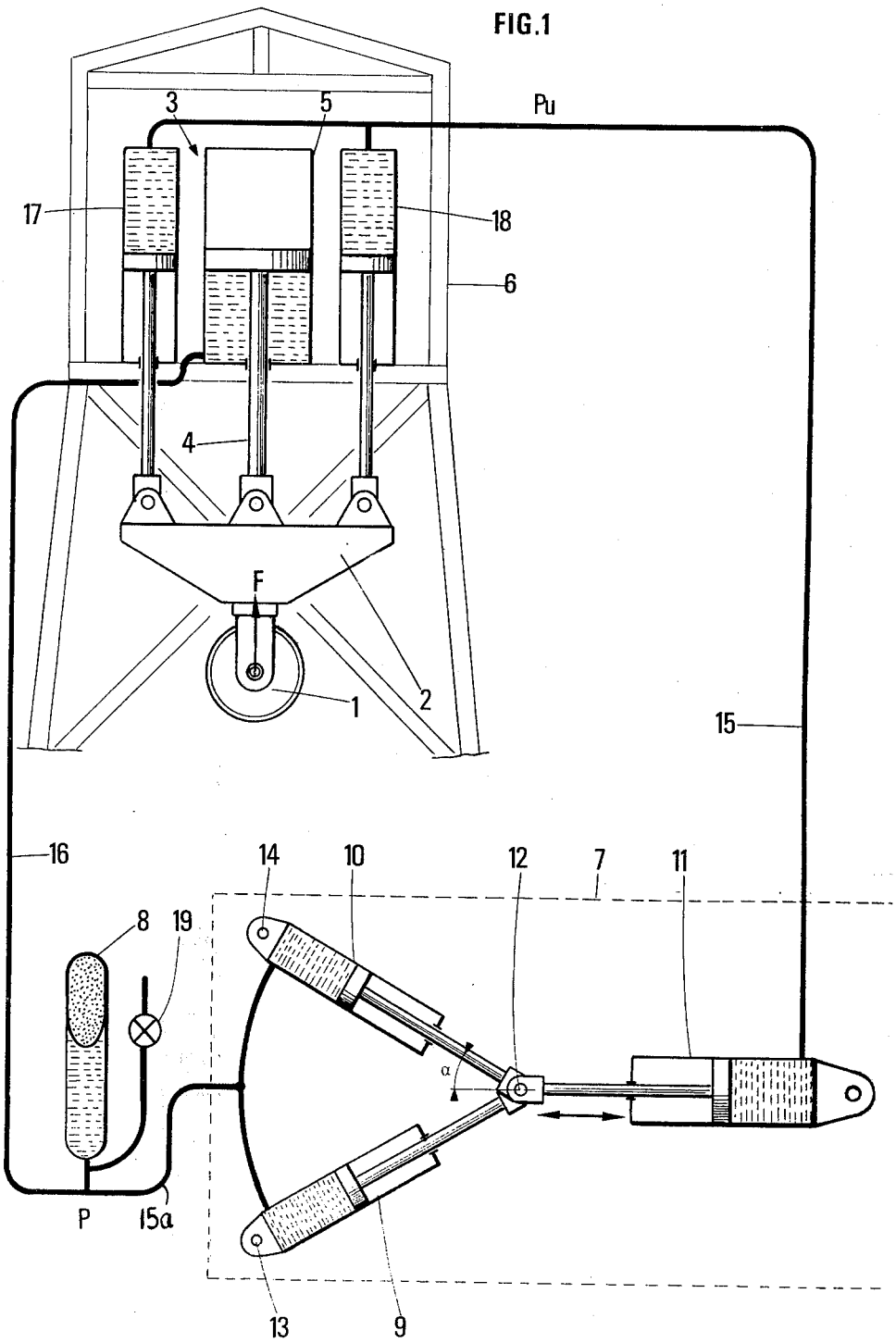
FIG. 1 illustrates a first embodiment of an apparatus according to the invention.

Attention is first drawn to the embodiment illustrated by FIG. 1, which diagrammatically shows an apparatus according to the invention used for off-shore drilling operations performed from an installation subjected to vertical movements, this apparatus being designed for applying to a drill pipe such as a conventional drill string (not shown) supported, for example, by a block 1 through cables, a tractive force F which remains substantially constant in spite of the vertical movements of the installation, so as to maintain at a predetermined value the load applied to the drill tool (this load being equal to the difference between the weight of the drill string above the tool and the tractive force applied to this drill string through block 1).

The block 1 is secured to a support member 2, carried by one element (for example the rod 4) of a main jack 3, the other element (i.e. the cylinder 5 of this jack) being fixed to the top of the derrick 6.

The apparatus also includes a regulating device designated as a whole by reference numeral 7 and associated to a source of pressurized fluid, such as the oleopneumatic accumulator 8 (it is possible to use one or a plurality of pneumatic or oleopneumatic accumulators).

Instead of pneumatic or oleopneumatic accumulators it will also be possible to make use of a source of fluid to which a pressure is applied through resilient means, such as, for example, spring means, acting on a piston.

In the embodiment of FIG. 1, the regulating device is formed by a group of three jacks 9, 10 and 11, each having one element (in this example the piston-rod) connected to one element of the other jacks through the moveable articulation 12.

The jacks 9 and 10 are pivotably mounted on stationary points 13 and 14 of the installation.

The axis of jack 11 extending, in this embodiment, along the symmetry axis of the segment connecting points 13 and 14, the moveable articulation 12 is displaceable along this symmetry axis, as indicated by the arrows.

The jacks 9 and 10 are fed with fluid under pressure P from the accumulator 8 and the jack 11 supplies through pipe 15 an auxiliary hydraulic fluid under the pressure $P_u$.

In the apparatuses which have been proposed up to now, the regulating device is connected "in series" between the cylinder of the main jack 5 and the accumulator 8.

In the device according to the invention a substantial reduction in the volume (and consequently in the bulkiness and in the cost) of the accumulator 8 is obtained by connecting in parallel, to the accumulator, the main jack 5 through pipe 16 and the regulating device 7 through pipe 15a.

The main jack 3 is connected to the accumulator 8 through pipe 16, and pipe 15 delivers pressurized auxiliary fluid to means for exerting an adjusting force which is opposed to (FIGS. 1, 1A, 2, 2A) or, alternatively, which has the same direction as (FIGS. 5 and 6) the force exerted by the main jack 5, in order to apply to the block 1 a force which is accurately determined.

In the first embodiment of the invention, illustrated by FIG. 1, these adjusting means are formed of two adjusting jacks 17 and 18 exerting an action opposed to that of the main jack 5.

The predetermined value of the force F exerted by the apparatus for each position of the piston of the main jack may be selected at will by adjusting, through valve 19, the quantity of fluid in the feeding circuit to the main jack 5 and the regulating device 7 connected to the accumulator 8.

Figure 1A:
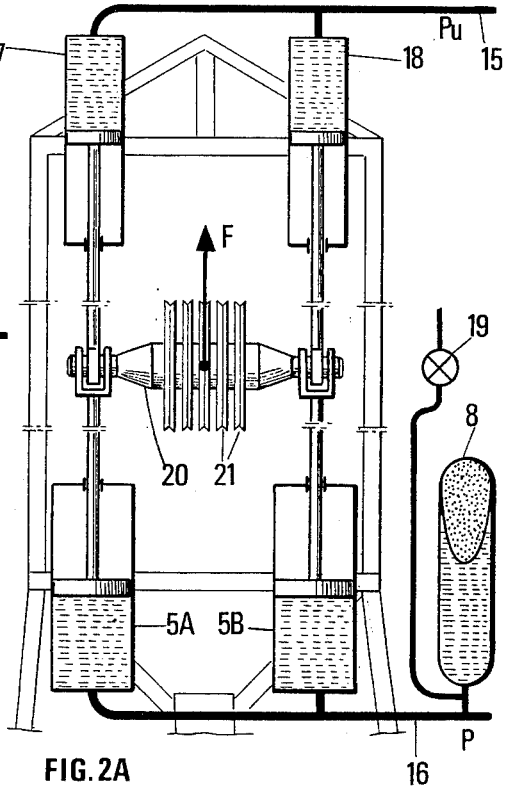
FIG. 1A illustrates a modification of this first embodiment.

FIG. 1A shows a modification of the preceding embodiment wherein two jacks 5A and 5B have been substituted for the main jack 5, said jacks being placed below the adjusting jacks 17 and 18. The force F is applied through a shaft 20 carrying pulleys 21.

Figure 2:
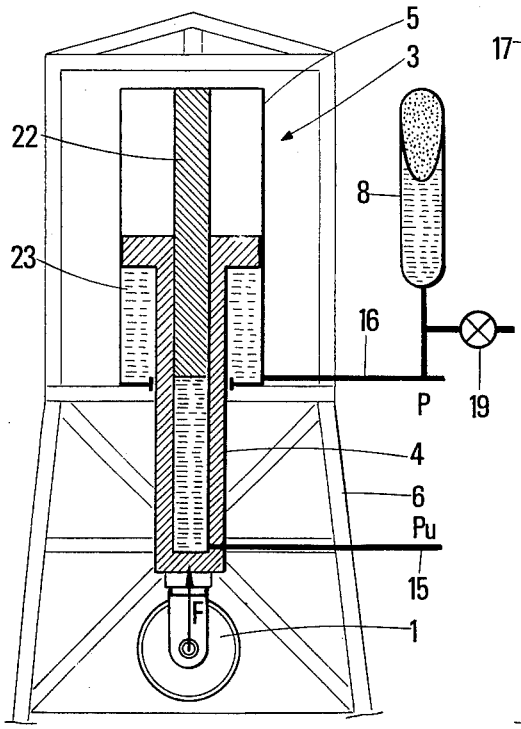
FIG. 2 shows a second embodiment.

FIG. 2 illustrates a second embodiment, wherein the stem 4 of the main jack is hollow and slidably mounted on a guide-rod 22 fixed to the cylinder 5 of jack 3.

The accumulator 8 is connected through pipe 16 to the chamber 23 of jack 3, located on the side of the hollow stem 4 of the piston, the pressure prevailing in this compartment being thus substantially equal to the pressure P in the accumulator and the interior of this hollow stem is fed with pressurized auxiliary fluid at the pressure $P_u$ through pipe 15 from a regulating device (not shown) which may, for example be of the type of the device 7 illustrated by FIG. 1.

It appears that the apparatuses of FIGS. 1, 1A and 2 operate substantially in the same way, the pressure P and $P_u$ exerting opposite antagonistic actions producing the resulting force F.

Figure 2A:
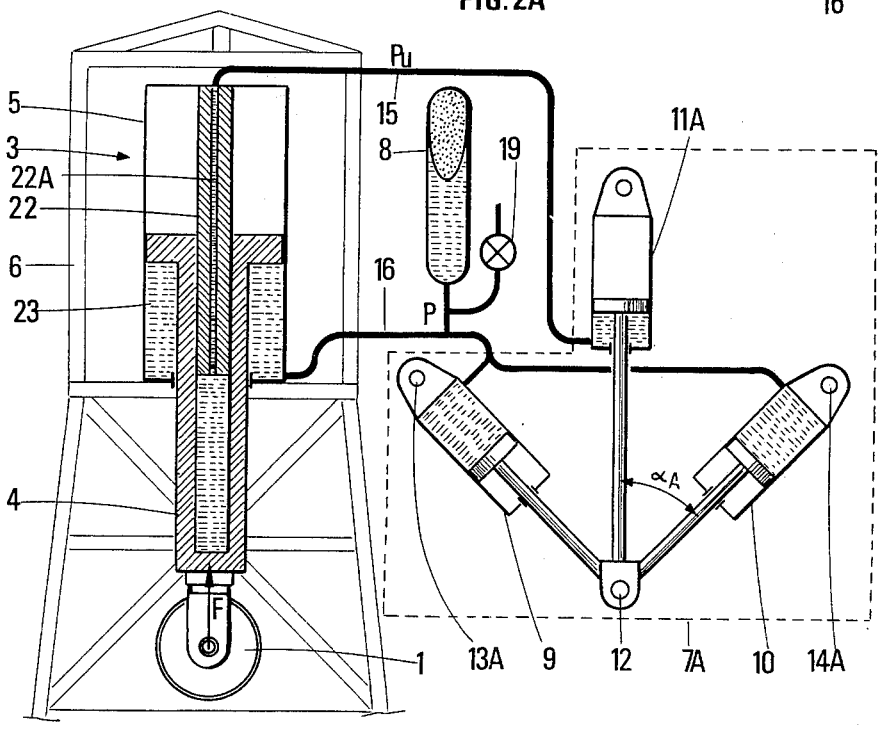
FIG. 2A illustrates a modification of this second embodiment.

In the alternative embodiment of FIG. 2A, the guide stem 22 is provided with an axial channel 22A for the admission of auxiliary fluid into the hollow stem 4 of jack 3.

In the regulating device 7A an arrangement of the jacks 9 and 10 different from that of the device 7 of FIG. 1 has been selected (these jacks are articulated about the stationary points 13A and 14A respectively), so that the piston rod of jack 11A is subjected to a traction, instead of a compression as in the regulating device of FIG. 1.

Such an arrangement may be substituted for that of the device 7 of FIG. 1 in any of the apparatuses according to the invention illustrated by FIGS. 1, 1A and 2.

It will be also possible in these apparatuses to substitute for the regulating device 7 or 7A any of the regulating devices illustrated in Patent applications Ser Nos. 248,727 and 248,728 filed on Apr. 28, 1972.

Figure 3:
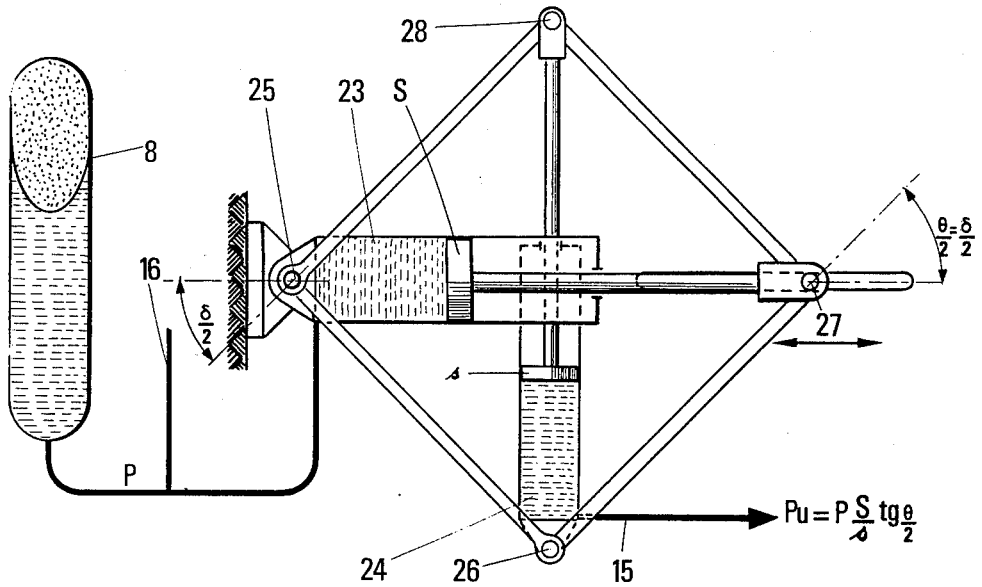
FIGS. 3 and 4 represent other types of regulating devices which can be used in the apparatus.
Figure 4:
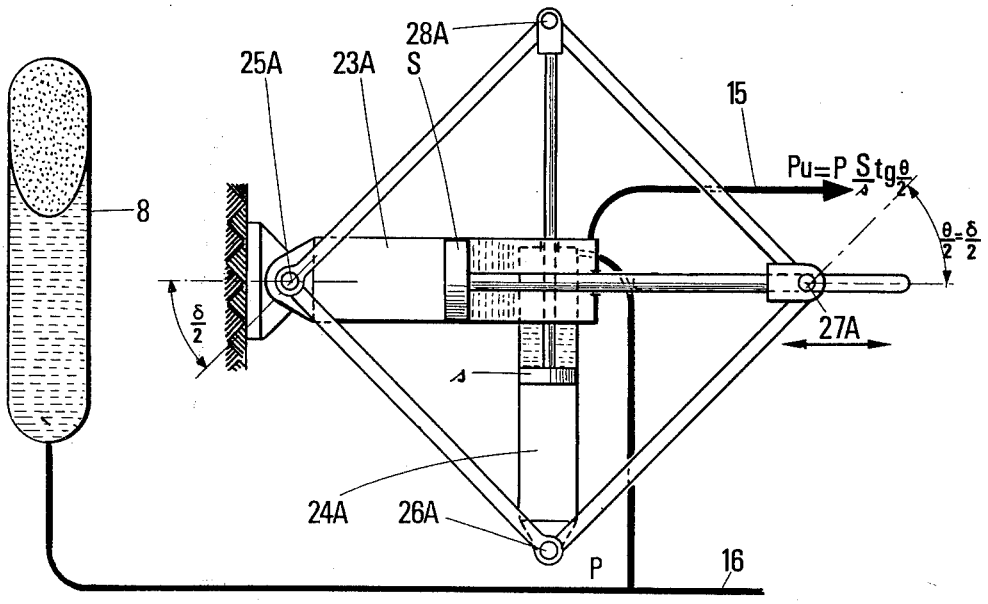

FIGS. 3 and 4 illustrate two other embodiments of the regulating device which may be used in any of the above-described apparatuses, in combination with a source of pressurized fluid, such as jack 8, instead of the device 7 of FIG. 1 or of the device 7A of FIG. 2A.

These regulating devices include two jacks (jacks 23 and 24, FIG. 3; jacks 23A and 24A, FIG. 4) whose elements are connected through rods articulated at the apices of a quadrilateral having diagonals perpendicular to each other (articulations 25 to 28, FIG. 3 and 25A to 28A, FIG. 4), the axes of these jacks extending along the diagonals of the quadrilateral. One of the articulation points of the jacks 23 and 23A is stationary (articulations 25, FIG. 3 and 25A, FIG. 4, respectively)

and the other articulation point is displaceable along a diagonal of the quadrilateral.

One cylinder of one of the jacks is connected to the accumulator 8 at the pressure P and the cylinder of the other jack contains an auxiliary fluid at the pressure $P_u$ which varies as a function of the pressure P in the accumulator 8 according to the relationship $$P_u = \frac{1}{2} P \frac{S}{s} \left(\tan \frac{\delta}{2} + \tan \frac{\theta}{2}\right)$$

S and $s$ being the respective piston areas of jacks 23 and 24, $\delta/2$ being the value of the half-angle at the apex 25 (or 25A) of the quadrilateral and $\theta/2$ being the value of the half-angle at the apex 27 (or 27A) of the quadrilateral, these angles varying as a function of the variations in the pressure P, which result in displacements of points 27 and 27A, respectively, in the directions indicated by the arrows and of points 26, 28, 26A and 28A in FIGS. 3 and 4. In the embodiments illustrated by FIGS. 3 and 4, the quadrilaterals 25, 26, 27, 28 and 25A, 26A, 27A, 28A are rhombs, i.e.

$$\frac{\delta}{2} = \frac{\theta}{2} \text{ and hence } P_u = P \frac{S}{s} \tan \frac{\theta}{2}$$

Those skilled in the art are able to determine by computation, in each particular case of use, the constructional parameters of the regulating device (devices 7 of FIG. 1, 7A of FIG. 2A or devices of FIG. 3 or of FIG. 4), i.e. the cross-section and stroke of the pivoting jacks, the limit values of the angles such as $\alpha$ (FIG. 1), $\alpha_A$ (FIG. 2A), $\theta/2$ and $\delta/2$ (FIGS. 3 and 4), in order to obtain, for each position of the piston of the main jack 3, (as a function of the vertical displacement of the floating installation), i.e. for each value of the pressure P in the accumulator 8, a value of the pressure $P_u$ of the auxiliary fluid supplied to the adjusting jacks resulting in a force F as close as possible to a predetermined value which has been selected taking into account, in particular, the influence of a suspension system placed between the drill pipe and the main jack 3.

Figure 5A:
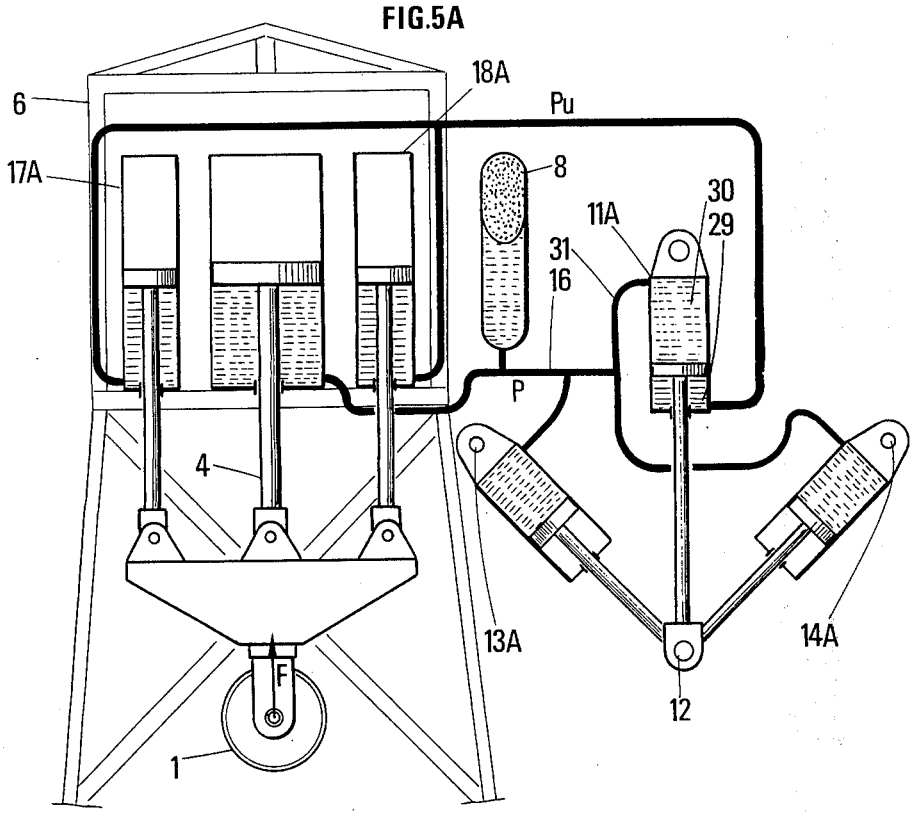
FIG. 5A shows an alternative embodiment of the regulating device used in the apparatus of FIG. 5.
Figure 5:
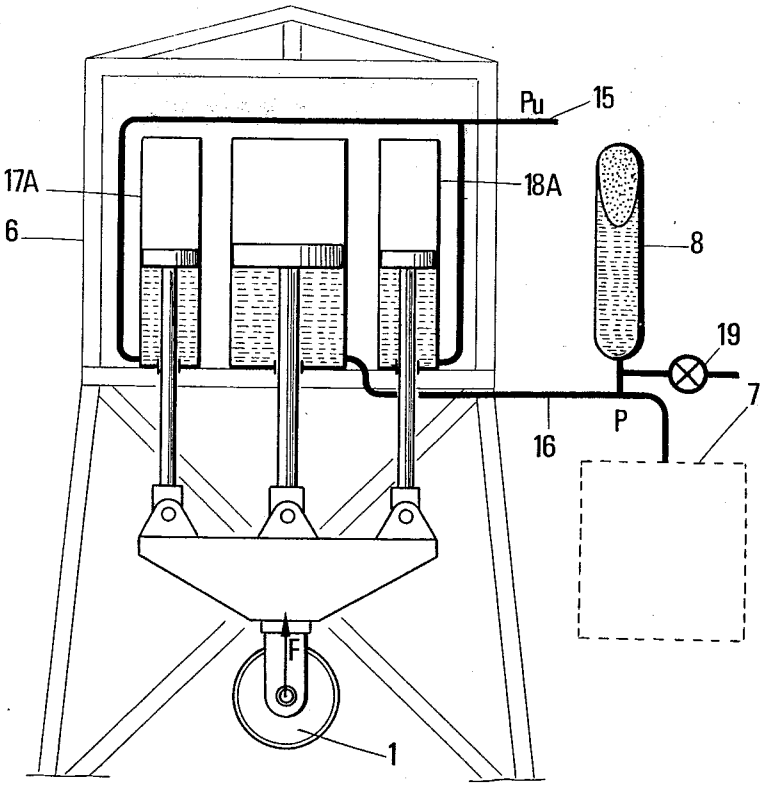
FIG. 5 illustrates a third embodiment of the invention.

FIG. 5 illustrates an embodiment of the invention wherein are used, in combination with the main jack 3, two adjusting jacks 17A and 18A exerting actions having the same directions as the one of the main jack.

These jacks are supplied with auxiliary fluid through pipe 15, this fluid being pressurized by means of a regulating device which is connected to the accumulator 8 and may be of the type of the device 7 of FIG. 1 or of the device 7A of FIG. 1A.

FIG. 5A represents a modification of the above-described embodiment, wherein the chamber 29 of jack 11A of the regulating device supplies the auxiliary fluid to the pipe 15 and the chamber 30 of this jack is connected to the accumulator 8 through a pipe 31.

Figure 6:
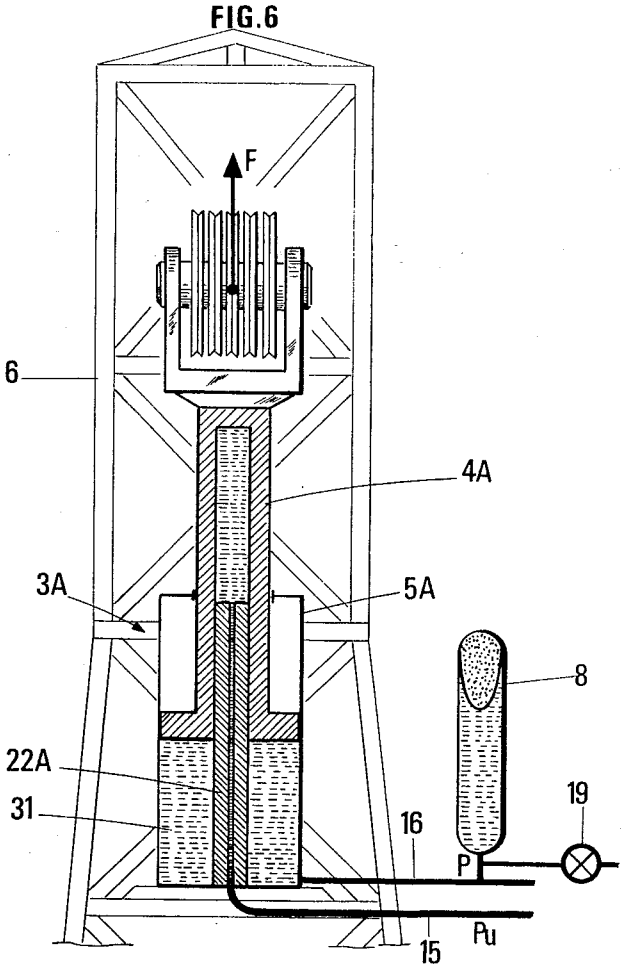
FIG. 6 represents a fourth embodiment of the invention.

FIG. 6 illustrates another embodiment of the invention, in which the jack 3A is provided with a piston having a hollow stem 4A slidably mounted on a guide-rod 22A secured to the cylinder 5A of the jack.

The accumulator 8 is connected through pipe 16 to the chamber 31 of the jack 3A located on the side opposite the hollow stem 4A, the pressure prevailing in this chamber being thus substantially equal to the pressure P in the accumulator and the interior of this hollow stem being supplied with auxiliary fluid at the pressure $P_u$ through pipe 15 from a regulating device which may, for example, be of the type illustrated in FIG. 1 or FIG. 5A.

In the apparatuses illustrated by FIGS. 5 and 6, it is possible, instead of using a regulating device such as the device 7 of FIG. 1 or the device 7A of FIG. 1A, to use a regulating device such as that illustrated by FIG. 4. It is however not possible, in these apparatuses, to use a regulating device of the type illustrated by FIG. 3.

This fact can be understood when considering that in the lowermost position of the block 1, the pressure P supplied by the accumulator 8 is high and consequently the force F reaches its maximum value.

In this position of the block, the cylinders of the adjusting jacks 17A and 18A are empty, the piston of jack 24A of the regulating device of FIG. 3 would then be in its lowermost position to which corresponds the maximum value of the angle $\theta/2$. The pressure $P_u$ supplied by the jack 24, which is proportional to the product P tan $\theta/2$ would then be very high and would then add its effect to the effect of the pressure P, which would further increase the force F.

What we claim is:

1. An apparatus for an installation subjected to alternate displacements, wherein said apparatus maintains a predetermined force on an extended element connected to said installation, said apparatus comprising at least one main jack, at least one pressurized fluid accumulator, said main jack being supplied with said pressurized fluid from said accumulator for maintaining the extended element under tension, and a regulating device connected to said accumulator in parallel with said main jack, said regulating device comprising at least two regulating jacks whose axes form an angle therebetween, said regulating jacks being connected by at least one articulation, and said apparatus further comprising at least one adjusting jack connected to said regulating device, said adjusting jack applying an adjustment force on the extended element, and said adjusting jack having a fixed orientation in relation to that of said main jack, said adjusting jack applying said adjustment force to the extended element along the entire path of action of said main jack during changes in pressure in said accumulator and thereby adjust for changes in pressure in said accumulator, thereby producing the predetermined force on the extended element.

2. An apparatus according to claim 1, wherein said at least one adjusting jack produces said adjustment force opposite to the tension force exerted by said main jack, said adjusting jack having a cylinder being fed with pressurized auxiliary fluid from said regulating device.

3. An apparatus according to claim 2, wherein two adjusting jacks are connected to said regulating device for producing said adjustment force opposite to the tension force exerted by said main jack on the extended element.

4. An apparatus according to claim 3, wherein each of said two adjusting jacks and said at least one main jack include a piston cylinder, a piston and a piston rod, said piston rod of each jack being connected to a support member for the extended element.

5. An apparatus according to claim 4, wherein said pressurized fluid is supplied to the piston cylinder of said main jack to provide said tension force on said extended member, while auxiliary pressurized fluid is supplied to the piston cylinders of said two adjusting jacks from said regulating device to provide said adjustment force on said extended member opposite to said tension force.

6. An apparatus according to claim 5, wherein at least one of said at least two regulating jacks is further connected to a pivot point, and wherein said articulation is movable along a predetermined path such that the angle formed between the axes of the regulating jacks is variable.

7. An apparatus according to claim 1, wherein said at least one adjusting jack is comprised of a hollow stem of the main jack piston which is slidably mounted on a guide rod fixed to the main jack cylinder, said accumulator of pressurized fluid being connected to the chamber of said main jack which is located on the same side as said hollow piston stem, and the interior of said hollow stem being supplied with pressurized auxiliary fluid from said regulating device.

8. An apparatus according to claim 7, wherein said guide rod is provided with a longitudinal channel for admitting said pressurized auxiliary fluid into said hollow stem.

9. An apparatus according to claim 1, wherein said at least one adjusting jack produces said adjustment force in the same direction as the tension force exerted by said main jack, said adjusting jack having a cylinder being supplied with pressurized auxiliary fluid from said regulating device.

10. An apparatus according to claim 1, wherein said at least one adjusting jack is comprised of a hollow stem of the main jack piston which is slidably mounted on a guide rod fixed to the main jack cylinder, said accumulator of pressurized fluid being connected to the chamber of said main jack which is located on the side opposite to said hollow piston stem, and the interior of said hollow stem being supplied with pressurized auxiliary fluid from said regulating device.

11. An apparatus according to claim 10, wherein said guide rod is provided with a longitudinal channel for admitting said pressurized auxiliary fluid into said hollow stem.

12. An apparatus according to claim 1, wherein said accumulator of pressurized fluid is connected to at least one jack of said regulating device for supplying pressurized auxiliary fluid to said adjusting jack such that the pressure of said accumulator and the pressure of said auxiliary fluid are applied to different sides of the piston of said main jack.

13. An apparatus according to claim 1, wherein said regulating device comprises a group of jacks, one element of at least one of said jacks being connected through a moveable articulation to an element of at least another jack of the same group, at least one jack of said group being pivotally mounted about a stationary point through its element which is not connected to the moveable articulation, said articulation being compelled to move along a predetermined path, the axis of said pivoting jack remaining inclined relative to said path during its rotation, at least one jack of said group being fed with said pressurized fluid from said accumulator and at least one jack of said group being connected to the cylinder of said at least one adjusting jack through a pipe supplying hydraulic fluid which constitutes pressurized auxiliary fluid.

14. An apparatus according to claim 9, wherein said regulating device comprises, in combination, at least one pair of jacks whose elements are interconnected through articulated coupling rods at the apices of a quadrilateral the axes of the jacks extending along the diagonals of this quadrilateral, at least one articulation point of the jacks of said pair being stationary and the other articulation point of this jack being displaceable along a diagonal of said quadrilateral, the cylinder of a first of said jacks being connected to said accumulator of pressurized fluid, the cylinder of a second jack containing the pressurized auxiliary fluid and said adjusting jack being fed with pressurized auxiliary fluid through said second jack, the connection of said accumulator of pressurized fluid to said first jack and the connection of said adjusting jack to said second jack being both effected on the side of the pistons of said jacks to which correspond the application of a tractive force through said jacks to their piston rods.

15. An apparatus according to claim 1, wherein at least one of said at least two regulating jacks is further connected to a pivot point, and wherein said articulation is movable along a predetermined path such that the angle formed between the axes of the regulating jacks is variable.

16. An apparatus for an installation subjected to alternate displacements, wherein said apparatus maintains a predetermined force on an extended element connected to said installation, said apparatus comprising at least one main jack, at least one pressurized fluid accumulator, said main jack being supplied with said pressurized fluid from said accumulator for maintaining the extended element under tension, and a regulating device connected to said accumulator in parallel with said main jack, said regulating device comprising at least two regulating jacks whose axes form an angle therebetween, said regulating jacks being connected by at least one articulation, and said apparatus further comprising at least one adjusting jack connected to said regulating device, said adjusting jack applying an adjustment force on the extended element, and said adjusting jack having a fixed orientation in relation to that of said main jack to apply said adjustment force to the extended element along the entire path of action of said main jack, thereby producing the predetermined force on the extended element, wherein at least one of said at least two regulating jacks is further connected to a pivot point, and wherein said articulation is movable along a predetermined path such that the angle formed between the axes of the regulating jacks is variable, and wherein said regulating device comprises three regulating jacks, two of said three regulating jacks being supplied by said pressurized fluid from said accumulator, and the other of said three regulating jacks supplying auxiliary pressurized fluid to said at least one adjusting jack.

17. An apparatus according to claim 16, wherein said two of said three regulating jacks are connected to a pivot point such that action of at least one of said pressurized fluid in said two regulating jacks or said auxiliary pressurized fluid in said other of said three regulating jacks varies the respective angles between the axes of each of said three regulating jacks.

18. An apparatus according to claim 17, wherein the pressure of said auxiliary pressurized fluid in said other of said regulating jacks varies as a function of the pressure of said pressurized fluid supplied from said accumulator, thereby varying the adjustment force applied by said adjusting jack on the extended element.

19. An apparatus according to claim 16, wherein said two of said three regulating jacks are connected to said accumulator in parallel, each of said two regulating jacks forming a variable volume chamber supplied with said pressurized fluid, the pressure of said pressurized fluid varying in inverse proportion relative to said variable volume.

20. An apparatus according to claim 16, wherein two adjusting jacks are connected to said other of said three regulating jacks, said other regulating jack supplying said auxiliary pressurized fluid to said two adjusting jacks, thereby producing said adjustment force.

21. An apparatus for an installation subjected to alternate displacements, wherein said apparatus maintains a predetermined force on an extended element connected to said installation, said apparatus comprising at least one main jack, at least one pressurized fluid accumulator, said main jack being supplied with said pressurized fluid from said accumulator for maintaining the extended element under tension, and a regulating device connected to said accumulator in parallel with said main jack, said regulating device comprising at least two regulating jacks whose axes form an angle therebetween, said regulating jacks being connected by at least one articulation, and said apparatus further comprising at least one adjusting jack connected to said regulating device, said adjusting jack applying an adjustment force on the extended element, and said adjusting jack having a fixed orientation in relation to that of said main jack to apply said adjustment force to the extended element along the entire path of action of said main jack, thereby producing the predetermined force on the extended element, wherein said at least one adjusting jack produces said adjustment force opposite to the tension force exerted by said main jack, said adjusting jack having a cylinder being fed with pressurized auxiliary fluid from said regulating device, wherein two adjusting jacks are connected to said regulating device for producing said adjustment force opposite to the tension force exerted by said main jack on the extended element, wherein each of said two adjusting jacks and said at least one main jack include a piston cylinder, a piston and a piston rod, said piston rod of each jack being connected to a support member for the extended element, wherein said pressurized fluid is supplied to the piston cylinder of said main jack to provide said tension force on said extended member, while auxiliary pressurized fluid is supplied to the piston cylinders of said two adjusting jacks from said regulating device to provide said adjustment force on said extended member opposite to said tension force, wherein at least one of said at least two regulating jacks is further connected to a pivot point, and wherein said articulation is movable along a predetermined path such that the angle formed between the axes of the regulating jacks is variable, and wherein said regulating device comprises three regulating jacks, two of said three regulating jacks being supplied by said pressurized fluid from said accumulator, and the other of said three regulating jacks supplying auxiliary pressurized fluid to said two adjusting jacks.

* * * * *